US006194981B1

(12) United States Patent
Henderson et al.

(10) Patent No.: US 6,194,981 B1
(45) Date of Patent: Feb. 27, 2001

(54) SLOT LINE BAND REJECT FILTER

(75) Inventors: Bert C. Henderson, Sunnyvale; Clifford A. Mohwinkel, San Jose, both of CA (US)

(73) Assignee: Endwave Corporation, Sunnyvale, CA (US)

( * ) Notice: Subject to any disclaimer, the term of this patent is extended or adjusted under 35 U.S.C. 154(b) by 0 days.

(21) Appl. No.: 09/283,704

(22) Filed: Apr. 1, 1999

(51) Int. Cl.[7] ..... H01P 1/20; H01P 7/00
(52) U.S. Cl. ..... 333/204; 333/205; 333/219
(58) Field of Search ..... 333/204, 205, 333/219

(56) References Cited

U.S. PATENT DOCUMENTS 3,688,225 * 8/1972 Cohn ..... 333/204
3,939,430 * 2/1976 Dickens et al. ..... 325/446
5,426,402 * 6/1995 Mariani ..... 333/205
5,448,211 * 9/1995 Mariani ..... 333/205
5,584,067 * 12/1996 Buer et al. ..... 333/204

* cited by examiner

*Primary Examiner*—Robert Pascal
*Assistant Examiner*—Patricia T. Nguyen
(74) *Attorney, Agent, or Firm*—Steven J. Adamson; Edward B. Anderson

(57) ABSTRACT

A slot line band reject pass filter including a substrate of insulating material having slot line primary conductors formed thereon. One or more supplemental conductors are preferably coupled to the slot line primary conductors to achieve rejection of a desired frequency. Several embodiments of supplemental conductors are disclosed including substantially closed loop and non loop segments that extend in a range from parallel to perpendicular from the primary conductors. The supplemental conductors may be directly or electromagnetically coupled, or both.

22 Claims, 2 Drawing Sheets

SLOT LINE BAND REJECT FILTER

FIELD OF THE INVENTION

The present invention relates to slot line band reject filters.

BACKGROUND OF THE INVENTION

The prior art provides several types of filters for use with radio frequency signals including high pass, low pass, band pass, notch and other types of filters fabricated in lumped or distributed form. Filters of these types have been formed in a variety of transmission media.

To accommodate higher frequency signals some filters have been fabricated in microstrip transmission media using distributed elements. Microstrip transmission media generally consists of one or more thin conducting strips of finite width that are arranged parallel with a single extended conducting ground plan. In its common form, the strips are fixed to one side of an insulating substrate and the ground plane is attached to the other side. While microstrip transmission media have been recognized as possible conductors for higher frequency signals, microstrip transmission media also have disadvantageous aspects. These aspects include that the fabrication of microstrip circuits is process intensive, involving (1) metalization on two sides of a substrate and (2) the formation of interconnecting vias between the two surface materialization layers to achieve proper grounding.

Coplanar waveguide (CPW) and slot line are alternative types of transmission media. Both CPW and slot line support uniplanar fabrication, though they have not been used widely for high frequency signal propagation.

To provide less expensive and more efficient circuit construction, a need exists to form circuits that support high frequency operation (approximately >1 GHz) in a uniplanar transmission media. To provide necessary signal processing, a need exists to provide circuit components such as band reject filters and the like in such media. Suitable band reject filters will provide LO, image reject and spurious frequency filtering.

SUMMARY OF THE INVENTION

Accordingly, it is an object of the present invention to provide a slot line band reject filter.

It is another object of the present invention to provide a slot line band reject filter that affords flexibility in the design of performance characteristics.

It is another object of the present invention to provide a band reject filter that is compact in size.

It is also an object of the present invention to provide a uniplanar implemented image reject filter that is suitable for use in a radio system.

These and related objects of the present invention are achieved by use of a slot line band reject filter as disclosed herein.

The attainment of the foregoing and related advantages and features of the invention should be more readily apparent to those skilled in the art, after review of the following more detailed description of the invention taken together with the drawings.

DETAILED DESCRIPTION

Slot line transmission media generally consists of two semi-infinite coplanar conducting planes affixed to the same side of an insulating substrate of arbitrary thickness and separated by a finite gap. In the present invention, the slot line transmission media is preferably implemented in strip format. Amongst other benefits, slot line transmission media provides significant flexibility in component layout and the benefits of uniplanar fabrication.

The filters described herein are preferably formed on a substrate that may include fused silica, ceramic, plastic, Teflon, glass, air or the like. Though preferably formed with slot line strips, filters of the present invention may also be formed with infinite or semi-infinite ground planes.

Figure 1:
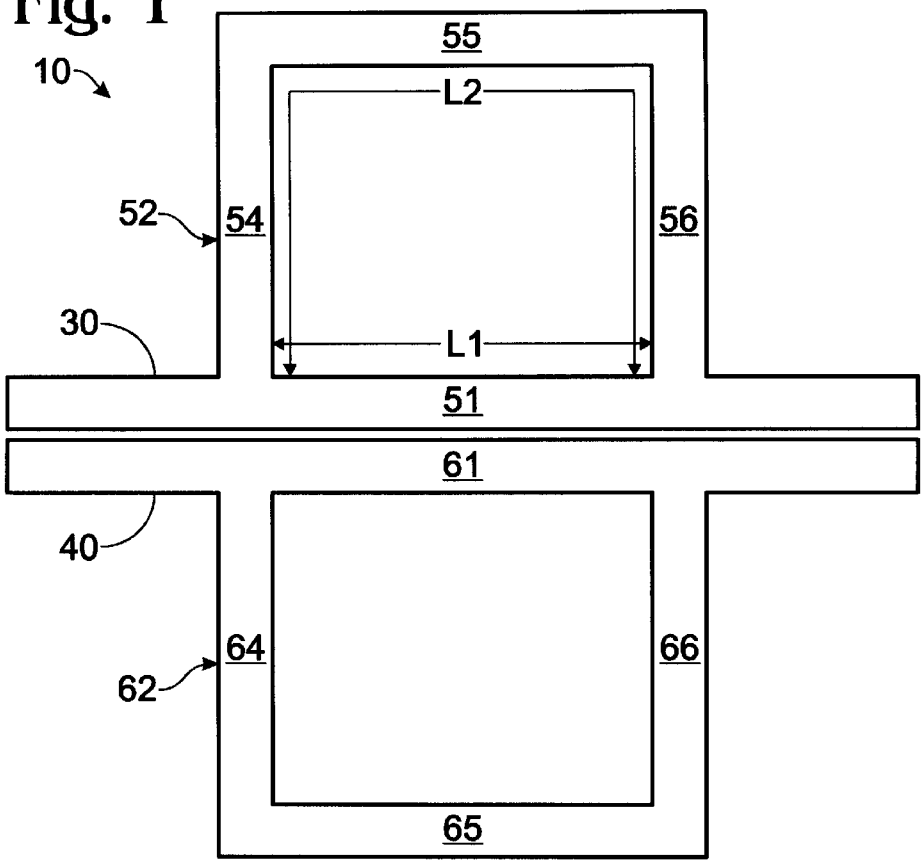
FIG. 1 is a diagram of a slot line band reject filter in accordance with the present invention.

Referring to FIG. 1, a diagram of a band reject filter in accordance to the present invention is shown. The band reject filter 10 includes a positive signal line 30 and a negative signal line 40. Positive signal line 30 is comprised of a principal positive conductor 51 and three conducting segments 54–56 (which form a supplemental conductor) arranged to form a loop 52 in conjunction with a section of conductor 51. Similarly, negative signal line 40 is comprised of a principal negative conductor 61 and three conducting segments 64–66 (which form a supplemental conductor) arranged to form a loop 62 in conjunction with a section of conductor 61.

Segments 54–56 have a combined length termed L2, while the section of conductor 51 defined by the intersection of segments 54,56 has a length termed L1. A similar conductor arrangement is provided in negative signal line 40. The rejection center frequency of filter 10 is inversely proportional to the difference between L1 and L2. Rejection of a desired frequency is achieved through destructive interference.

It should also be recognized that although members 54–56 are straight and orthogonally arranged, these members (and the principal conductors to which they attach) can be curved, zigzag, trapezoidal, circular, amorphous or otherwise shaped.

With respect to design criteria, it has been recognized that the center frequency, fc, of filter 10 relates to L1 and L2 as follows:

$$fc \cong \frac{C}{2(\epsilon_r)^{1/2}((L1 - L2)/2.91)}$$

where C is the speed of light, L1 and L2 are as shown in FIG. 1, and $\epsilon_r$ is the dielectric constant of the substrate. It should be recognized that fc is proportional to 1/(L1−L2) because fc generally increases as L2 increases.

Figure 2A:
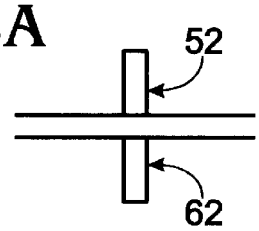
FIGS. 2A–2C are diagrams of alternative embodiments of the slot line band reject filter of FIG. 1 in accordance with the present invention.
Figure 2B:
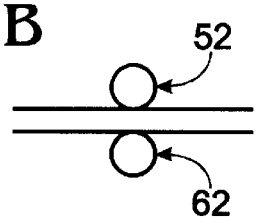
Figure 2C:
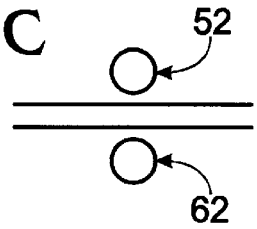

Referring to FIGS. 2A–2C, diagrams of alternative embodiments of the band reject filter of FIG. 1 in accordance with the present invention are shown. FIG. 2A illustrate a filter in which the loops 52,62 are configured such that the long dimension of L2 is disposed substantially perpendicular to the center line of the filter.

FIG. 2B illustrates the formation of loops 52,62 in a circular, oval or elliptical pattern. In this filter, L2 may approach a maximum while L1 may approach a minimum, depending on the final design. FIG. 2C illustrates generally circular loops 52,62 that are electromagnetically coupled to primary conductors 51,61. Though loops 52,62 of FIGS. 2B–2C are substantially circular as illustrated, other shapes may be utilized.

Figure 3A:
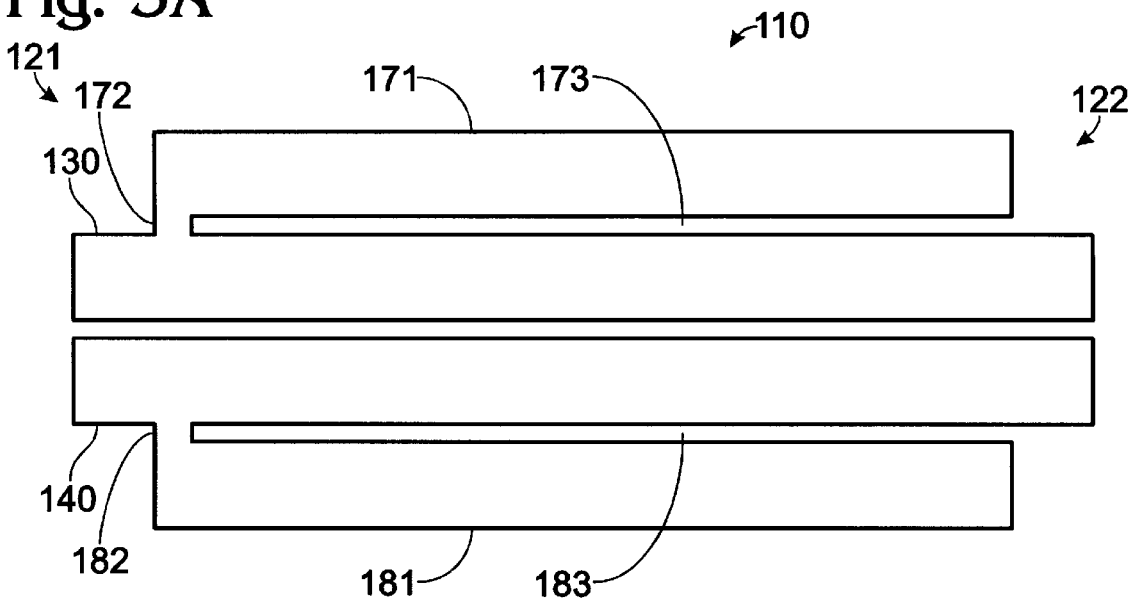
FIGS. 3A–3B are diagrams of other embodiments of a slot line band reject filter in accordance with the present invention.

Referring to FIG. 3A, a diagram of another embodiment of a band reject filter 110 in accordance with the present invention is shown. Band reject filter 110 includes positive and negative signal lines 130,140, respectively. Supplemental conductors (or resonators) 171,181 are respectively coupled through connecting conductors 172,182 and through gaps 173,183 to the positive and negative signal lines 130,140. The supplemental conductors 171,181 each have a length of approximately one-quarter wavelength of the rejection center frequency. Though conductors 172,182 are shown connecting the supplemental conductors to signal lines 130,140 proximate an input 121 of filter 110, one or both of connecting conductors 172,182 could alternatively be provided proximate an output 122 of filter 110 (i.e., connected at the other end of the supplemental conductor from the end shown). Frequency cancellation occurs by presenting a short circuit at the rejection center frequency to both the positive and negative signal lines 130,140. The short circuit is due to the open circuit at the end of supplemental conductors 171,181 transformed through a quarter-wave.

The impedance of the transmission line can be varied to optimize filter characteristics by modifying the width of supplemental conductors 171,181 and their respective spacing from the positive and negative signal lines.

Figure 3B:
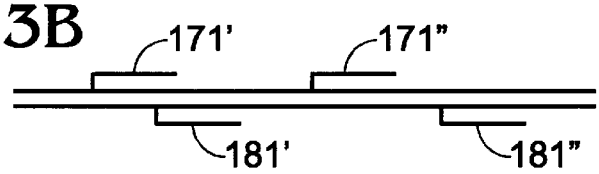

Referring to FIG. 3B, a diagram of another embodiment of a slot line band reject filter in accordance with the present invention is shown. The filter arrangement shown in FIG. 3B is similar to that shown in FIG. 3A, however, the supplemental conductors 171,181 are staggered as compared to being generally symmetrically positioned as shown in FIG. 3A. The left most pair of supplemental conductors 171',181' overlapped, while the right most pair of supplemental conductors 171',181' do not overlap. While the conductors 171,181 are shown paired, it should be recognized that the present invention includes non-pair supplemental conductors.

Figure 4:
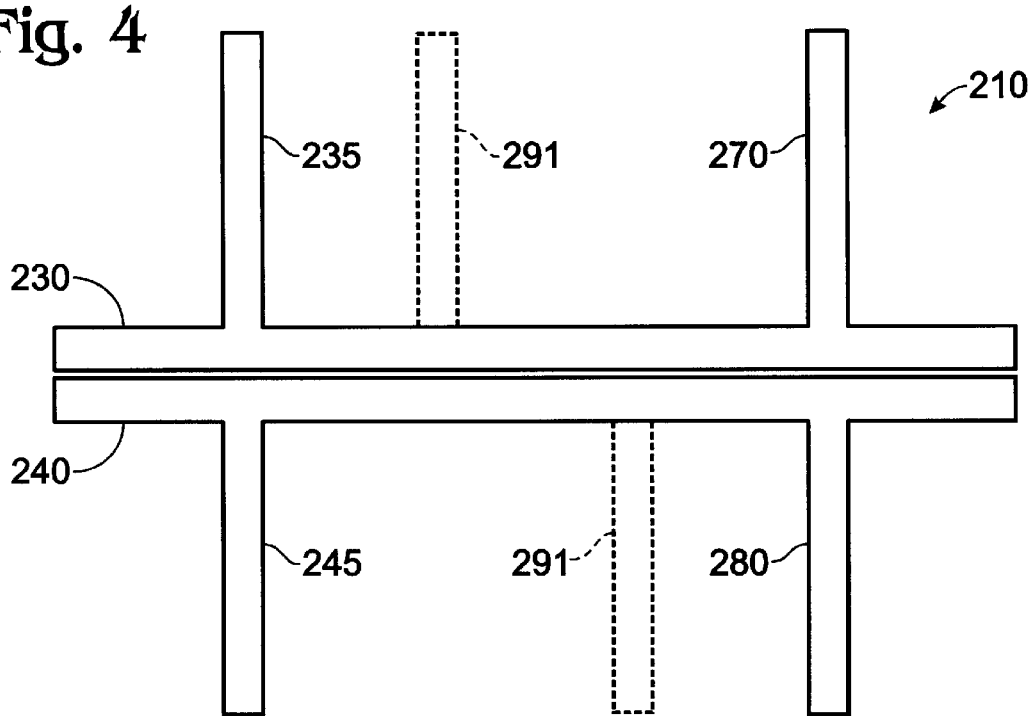
FIG. 4 is a diagram of other embodiments of a slot line band reject filter in accordance with the present invention.

Referring to FIG. 4, a diagram of another embodiment of a slot line band reject filter 210 in accordance with the present invention is shown. Filter 210 comprises positive and negative principal conductors 230,240, respectively. A pair of resonators (or supplemental conductors) 235,245, are coupled to the positive and negative signal lines. Each of these resonators is preferably a quarter wavelength (or multiple thereof) of a center frequency (of the rejection frequency) in length and open circuited such that each presents a short circuit at the principal conductor to signals approximately at the rejection center frequency. The short circuit attenuates these signals.

A second pair of resonators 270,280 may also be coupled to positive and negative signal lines 230,240. These resonators 270,280 are preferably a quarter wavelength of a center frequency in length and their spacing from resonator 235,245 is preferably approximately a half wavelength of the center frequency. The spacing is also preferably optimized to achieve a required rejection profile (band rejection depth and width).

It should be recognized that the band reject filter of FIG. 4 can be constructed by using only a single resonator, such as resonators 235 or 245, a plurality of staggered single resonators, a single pair of resonators or a plurality of pairs of resonators, or a combination thereof. Furthermore, supplemental conductors (resonators) of the types shown in FIGS. 3 and 4 could be combined. Considerations in filter design include providing a sufficient number and arrangement of resonators to achieve a desired rejection profile, while minimizing circuit size. Two single, staggered (asymmetrically arranged) resonators 291,292 are shown in dashed lines to achieve a desired band rejection filter profile.

It should further be recognized that while rectilinear edged supplemental conductors are shown herein, these conductors may have a non-rectilinear shape, including amorphous shapes that are empirically or otherwise determined to provide a desired profile. In addition, the performance of the filters described herein may be modified (optimized) by modifying the width of the supplemental conductors that achieve signal rejection.

Figure 5:
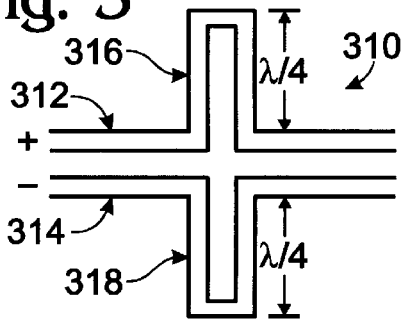
FIG. 5 is a diagram of another embodiment of a band reject slot line filter in accordance with the present invention.

Referring to FIG. 5, a diagram of another embodiment of a slot line band reject filter 310 in accordance with the present invention is shown. Filter 310 includes positive and negative supplemental conductors 316 and 318 that respectively extend from and return to the positive and negative principal conductors 312 and 314 in such a manner as to form transmission line (slot line) segments. The length of these transmission line segments 316,318 is preferably one-quarter wavelength of the rejection frequency such that a voltage minima is returned to the principal conductors for that frequency.

Figure 6:
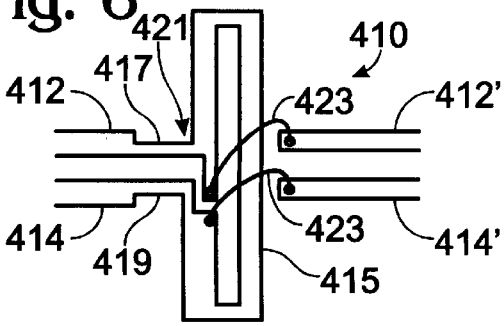
FIG. 6 is a diagram of another embodiment of a band reject slot line filter in accordance with the present invention.

Referring to FIG. 6, a diagram of another embodiment of a slot line band reject filter 410 in accordance with the present invention is shown. Filter 410 includes a supplemental conductor 415 which is connected to the positive and negative principal conductors 412,414 and forms a loop that is approximately an integer multiple of a wavelength of the rejection frequency. Inductive traces 417,418 and interdigitated capacitor 421 provide impedance matching. Leads 423 provide propagation of non-rejected frequencies through to output positive and negative single conductors 412',414'.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A slot line band reject filter, comprising:

a substrate of electrically insulating material having a first surface;

a first conductor formed in strip format on said first surface of said substrate;

a second conductor formed in strip format on said first surface of said substrate and arranged with said first conductor so as to form a slot line transmission media; and a first supplemental conductor formed in strip format on said first surface of said substrate and coupled to at least one of said first and second conductors in such a way as to bring about a substantial rejection of a desired frequency.

2. The slot line band reject filter of claim 1, further comprising a second supplemental conductor formed on said first surface of said substrate and coupled to the other of said first and second conductors in such a way as to bring about a substantial rejection of a desired frequency.

3. The slot line band reject filter of claim 1, wherein said first supplemental conductor has a length of approximately an odd integer multiple of a quarter wavelength of said desired frequency.

4. The slot line band reject filter of claim 1, wherein said first supplemental conductor forms a first loop.

5. The slot line band reject filter of claim 4, wherein said first loop has a long dimension disposed generally perpendicular to said at least one of said first and second conductors.

6. The slot line band reject filter of claim 4, wherein said first loop is electromagnetically coupled to said at least one of said first and second conductors.

7. The slot line band reject filter of claim 1, wherein said first supplemental conductor is electromagnetically coupled to said at least one of said first and second conductors.

8. The slot line band reject filter of claim 2, wherein said first and second supplemental conductors are arranged in a substantially parallel relationship with the conductors to which they are coupled.

9. The slot line band reject filter of claim 2, wherein said first and second supplemental conductors are arranged asymmetrically about a centerline of the first and second conductors.

10. The slot line band reject filter of claim 1, wherein said first supplemental conductor forms a transmission line segment.

11. The slot line band reject filter of claim 10, wherein said transmission line segment has a length of approximately an odd integer multiple of one-quarter wavelength of the rejection frequency.

12. The slot line band reject filter of claim 1, wherein said first supplemental conductor is connected between said first conductor and said second conductor and forms a resonator loop having a length of approximately an integer multiple of a wavelength of the rejection frequency.

13. The slot line band reject filter of claim 12, further comprising means for impedance matching formed within at least one of said first and second conductors and said loop.

14. A slot line band reject filter, comprising:

a substrate of electrically insulating material;

a first conductor formed in strip format on said substrate;

a second conductor formed in strip format on said substrate and arranged with said first conductor so as to form a slot line transmission media; and supplemental conductive material coupled to at least one of said first and second conductors that achieves rejection of a desired frequency;

wherein said supplemental conductive material and said first and second conductors are all formed on the same side of said substrate.

15. The slot line band reject filter of claim 14, wherein said supplemental conductive material forms a loop coupled to one of said first and said second conductors.

16. The slot line band reject filter of claim 14, wherein said supplemental conductive material forms a loop connected between said first and said second conductors.

17. The slot line band reject filter of claim 14, wherein said supplemental conductive material forms a transmission line segment.

18. A slot line band reject filter, comprising:

a substrate of electrically insulating material;

a first conductor formed in strip format on said substrate;

a second conductor formed in strip format on said substrate and arranged with said first conductor so as to form a slot line transmission media; and first supplemental conductive material coupled to at least one of said first and second conductors that has a length of an integer multiple of one-quarter wavelength of a rejection frequency of said filter;

wherein said supplemental conductive material is formed on the same side of said substrate as said first and second conductors.

19. The slot line band reject filter of claim 18, further comprising second supplemental conductive material coupled to the other of said first and second conductors that has a length of approximately an odd integer multiple of one-quarter wavelength of the rejection frequency.

20. The slot line band reject filter of claim 18, wherein said first supplemental conductive material forms a transmission line segment.

21. A slot line band reject filter, comprising:

a substrate of electrically insulating material;

a first conductor formed in strip format on said substrate;

a second conductor formed in strip format on said substrate and arranged with said first conductor so as to form a slot line transmission media; and a first supplemental conductor formed in strip format and coupled to at least one of said first and second conductors in such a way as to bring about a substantial rejection of a desired frequency;

a second supplemental conductor coupled to the other of said first and second conductors in such a way as to bring about a substantial rejection of a desired frequency; and wherein said first and second supplemental conductors are arranged in a substantially parallel relationship with the conductors to which they are coupled.

22. A slot line band reject filter, comprising:

a substrate of electrically insulating material;

a first conductor formed in strip format on said substrate;

a second conductor formed in strip format on said substrate and arranged with said first conductor so as to form a slot line transmission media; and a first supplemental conductor formed in strip format and coupled to at least one of said first and second conductors in such a way as to bring about a substantial rejection of a desired frequency; and a second supplemental conductor coupled to the other of said first and second conductors in such a way as to bring about a substantial rejection of a desired frequency;

wherein said first and second supplemental conductors are arranged asymmetrically about a centerline of the first and second conductors.

* * * * *